US009923313B1

(12) United States Patent
Yang

(10) Patent No.: US 9,923,313 B1
(45) Date of Patent: Mar. 20, 2018

(54) ELECTRICAL CONNECTOR

(71) Applicant: Jetmax Lighting Industrial Co., Limited, Dongguan (CN)

(72) Inventor: Ping Yang, Dongguan (CN)

(73) Assignee: Jetmax Lighting Industrial Co., Limited, Dongguan (CN)

( * ) Notice: Subject to any disclaimer, the term of this patent is extended or adjusted under 35 U.S.C. 154(b) by 0 days.

(21) Appl. No.: 15/661,410

(22) Filed: Jul. 27, 2017

(51) Int. Cl.

| | |
|---|---|
| ***H01R 13/625*** | (2006.01) |
| ***H01R 24/20*** | (2011.01) |
| ***H01R 13/502*** | (2006.01) |
| ***H01R 24/28*** | (2011.01) |
| ***H01R 13/24*** | (2006.01) |
| ***H01R 13/115*** | (2006.01) |
| ***H01R 13/52*** | (2006.01) |
| ***H01R 13/627*** | (2006.01) |
| *H01R 103/00* | (2006.01) |

(52) U.S. Cl.
CPC ..... *H01R 24/20* (2013.01); *H01R 13/115* (2013.01); *H01R 13/2457* (2013.01); *H01R 13/2492* (2013.01); *H01R 13/502* (2013.01); *H01R 13/5213* (2013.01); *H01R 13/6273* (2013.01); *H01R 24/28* (2013.01); *H01R 2103/00* (2013.01)

(58) Field of Classification Search
CPC ..... H01R 24/20; H01R 13/6273; H01R 2103/00; H01R 13/2457; H01R 13/502; H01R 13/5213; H01R 13/115; H01R 13/2492; H01R 24/28
USPC ..... 439/358
See application file for complete search history.

(56) References Cited

U.S. PATENT DOCUMENTS

| | | | | |
|---|---|---|---|---|
| 3,533,403 A * | 10/1970 | Woodson | ..... | A61B 5/0215 600/381 |
| 5,081,990 A * | 1/1992 | Deletis | ..... | A61N 1/0551 600/554 |
| 2009/0131769 A1* | 5/2009 | Leach | ..... | A61B 5/0031 600/309 |

(Continued)

FOREIGN PATENT DOCUMENTS

CN 104767087 A 7/2015

OTHER PUBLICATIONS

English abstract for CN104767087, Total of 1 page.

*Primary Examiner* — Jean F Duverne
(74) *Attorney, Agent, or Firm* — Tracy Helms; Apex Juris, pllc

(57) ABSTRACT

An electrical connector includes a male insertion piece and a female insertion piece. The male insertion piece has an insulation base, an insulation tube being hollow and formed on one end of the insulation base, an outer electrode securely mounted around the insulation tube, and a conductive needle mounted in the insulation tube. The female insertion piece has an insulation sleeve having a guiding slot for the insulation tube to be inserted therein, an outer connection electrode mounted inside the insulation sleeve and mounted around the outer electrode, and an inner connection electrode having a first conductive part abutting against a top portion of the conductive needle and at least two second conductive parts holding two lateral portions of the conductive needle. When the male insertion piece engages the female insertion piece, there are at least three contact positions forming a firm and stable triangular connection.

11 Claims, 9 Drawing Sheets

(56) References Cited

U.S. PATENT DOCUMENTS

| | | | | |
|---|---|---|---|---|
| 2010/0042110 | A1* | 2/2010 | Kelley | A61B 17/12 606/129 |
| 2011/0066254 | A1* | 3/2011 | Forsell | A61M 1/1068 623/23.64 |
| 2014/0066917 | A1* | 3/2014 | Cosman, Jr. | A61B 18/1477 606/33 |
| 2014/0121658 | A1* | 5/2014 | Cosman, Jr. | A61B 18/18 606/33 |

* cited by examiner

ELECTRICAL CONNECTOR

BACKGROUND OF THE INVENTION

1. Field of the Invention

The present invention relates to an electrical connector and, more particularly, to an electrical connector for wiring extension.

2. Description of the Related Art

To keep abreast of rising standard of living, people pay more and more attention to internal decoration of houses, such as ornamental lamps in a decorative space or on a Christmas tree. As the wiring length of the ornamental lamps are sometimes lengthy and unpredictable, extension cords are required for on-site wiring to meet specific demand. To meet the end of wiring using extension cords, there are many electrical connectors in the market. As disclosed in China Patent CN201510207244.1 entitled Power connector for Christmas tree, the power connector includes a male end and a female end for insertion assembly. The male end has a connection surface with a first conductive collar and a second conductive collar concentrically formed thereon. The female end has a connection surface with a first conductive contact and a second conductive contact formed thereon and electrically connected to the first conductive collar and the second conductive collar respectively. Such electrical connection between contacts and collars pertains to point-to-point contact, which is likely to result in bad connection and malfunction of ornamental lamps on the Christmas tree in connection with the power connector.

SUMMARY OF THE INVENTION

An objective of the present invention is to provide an electrical connector ensuring reliability in electrical connection and operational convenience.

To achieve the foregoing objective, the electrical connector includes a male insertion piece and a female insertion piece.

The male insertion piece has an insulation base, an insulation tube, an outer electrode, and a conductive needle.

The insulation tube is hollow and is formed on one end of the insulation base.

The outer electrode is securely mounted around a periphery of the insulation tube.

The conductive needle is mounted in the insulation tube.

The female insertion piece has an insulation sleeve, an outer connection electrode, and an inner connection electrode.

The insulation sleeve has a guiding slot formed inside the insulation sleeve for the insulation tube to be inserted into the guiding slot.

The outer connection electrode is mounted inside the insulation sleeve, and is mounted around and contacts a periphery of the outer electrode of the male insertion piece.

The inner connection electrode is mounted inside the insulation sleeve, contacts the conductive needle of the male insertion piece, and has a first conductive part and at least two second conductive parts.

The first conductive part abuts against a top portion of the conductive needle.

The at least two second conductive parts hold two lateral portions of a periphery of the conductive needle.

When the male insertion piece engages the male insertion piece, the insulation tube is inserted into the guiding slot, an inner surface of the outer connection electrode abuts against an outer surface of the outer electrode, and the top portion and the lateral portions of the periphery of the conductive needle abut against the first conductive part and the at least two conductive parts of the inner connection electrode respectively.

Preferably, the at least two second conductive parts of the inner connection electrode include two second conductive parts located on two lateral sides of the first conductive part.

Preferably, the at least two second conductive parts of the inner connection electrode include two second conductive parts formed on a front side and/or a rear side of the first conductive part.

Preferably, the outer connection electrode is tubular and has two positioning legs formed on an edge of one of two openings of the outer connection electrode, and the insulation sleeve has two limiting grooves formed in an inner wall of the insulation sleeve and engaging the respective positioning legs.

Preferably, the outer electrode has an arced slice formed on the periphery of the insulation tube, the insulation tube has a bulged portion formed around a central portion of the outer electrode, and the arced slice has multiple slits centrally formed through the arced slice.

Preferably, the outer electrode has a first wiring terminal formed on one end of the outer electrode adjacent to the insulation base, and the insulation base has an insertion slot formed therein for the first wiring terminal of the outer electrode to be inserted in the insertion slot.

Preferably, the outer electrode has a first wiring terminal formed on one end of the outer electrode adjacent to the insulation base, and the insulation base has an insertion slot formed therein for the first wiring terminal of the outer electrode to be inserted in the insertion slot.

Preferably, the insulation sleeve includes a left half sleeve and a right half sleeve.

The left half sleeve has an inner holding recess for the inner connection electrode to be mounted therein and an outer holding recess for the outer connection electrode to be mounted therein.

Preferably, the electrical connector further includes an inner protection tube, wherein the insulation base has two first engagement legs formed on and protruding outwardly from one end thereof distal to the insulation tube, each first engagement leg has a first protrusion formed on an outer surface thereof, one end of the inner protection tube is mounted around a periphery of the insulation sleeve, and the other end of the inner protection tube has two first engagement holes respectively formed through two opposite locations of a peripheral wall of the inner protection tube and respectively engaging the first protrusions of the two first engagement legs and is mounted around a periphery of the insulation base.

Preferably, the electrical connector further includes an outer protection tube, wherein the female insertion piece has an outer connection tube formed on one end of the insulation sleeve distal to the outer holding recess, an outer diameter of the outer connection tube is greater than an inner diameter of the inner protection tube, the outer connection tube has two second engagement legs formed on and protruding outwardly from the outer connection tube, each second engagement leg has a second protrusion formed on an outer surface of the second engagement leg, the outer protection tube has two second engagement holes engaging the respective second protrusions, one end of the outer protection tube is mounted around a periphery of the inner protection tube, and the other end of the outer protection tube is mounted around the outer connection tube with the second engagement holes engaging the respective second protrusions.

Preferably, the insulation base has at least two first engagement legs formed thereon and protruding outwardly, and the outer connection tube has at least two second engagement legs formed thereon and protruding outwardly.

The advantages gained from the present invention include at least three contact positions forming a firm and stable triangular connection when the conductive needle is electrically connected with the inner connection electrode.

Other objectives, advantages and novel features of the invention will become more apparent from the following detailed description when taken in conjunction with the accompanying drawings.

DETAILED DESCRIPTION OF THE INVENTION

Figure 1:
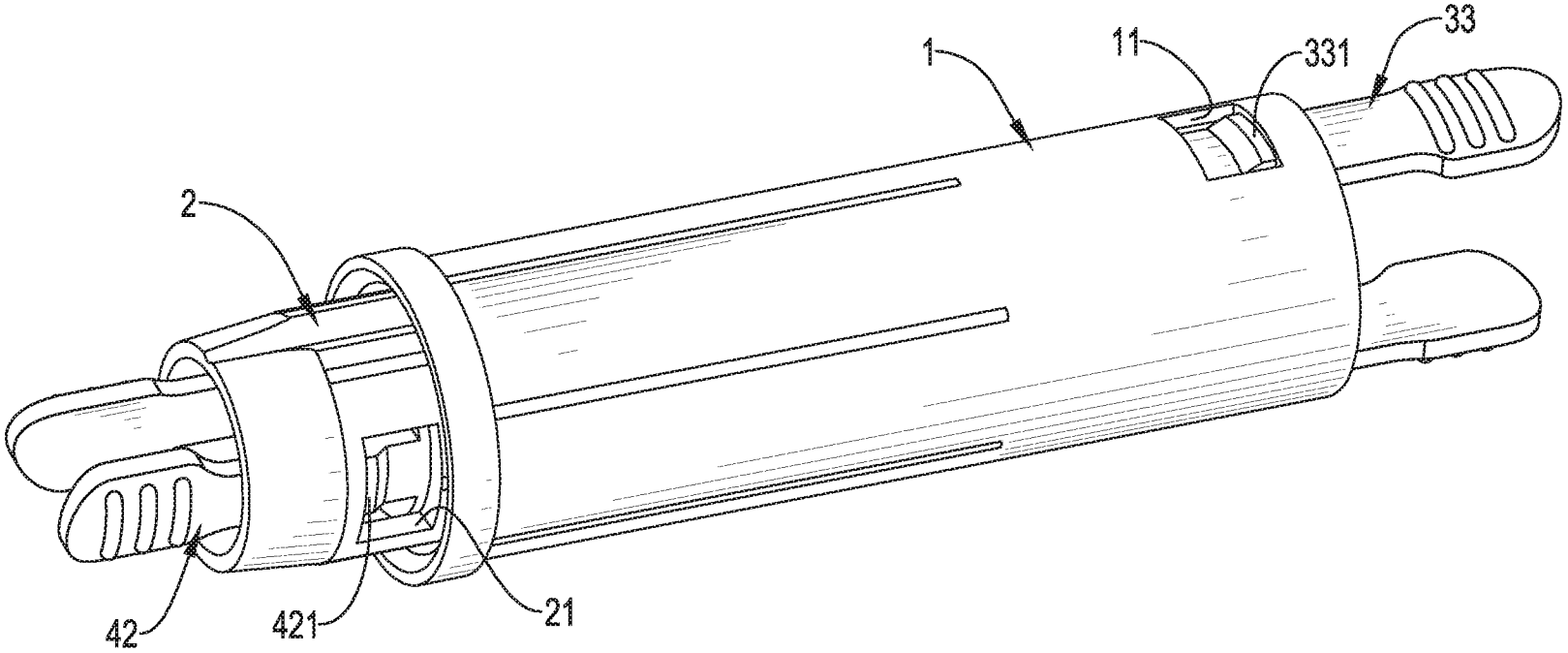
FIG. 1 is a perspective view of an electrical connector in accordance with the present invention.
Figure 2:
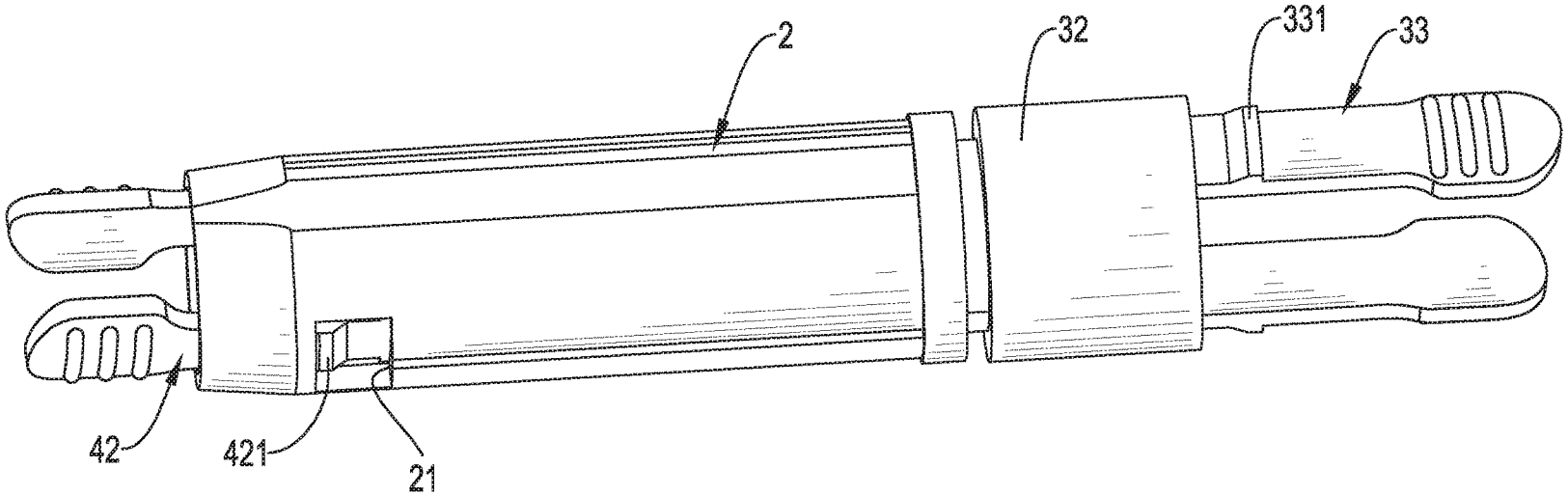
FIG. 2 is a perspective view of the electrical connector in FIG. 1, shown without an outer protective sleeve.
Figure 3:
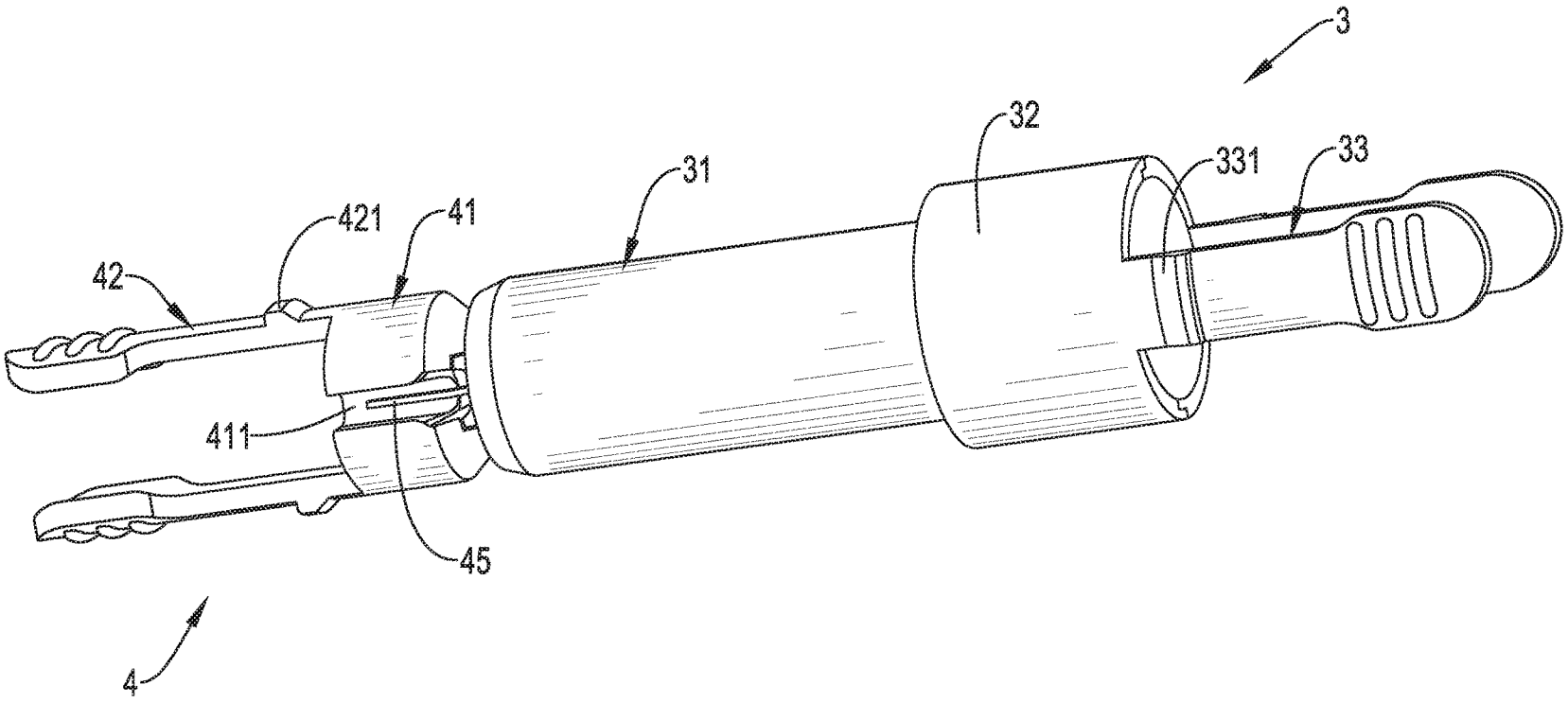
FIG. 3 is a perspective view of the electrical connector in FIG. 2, shown without an inner protective sleeve.
Figure 4:
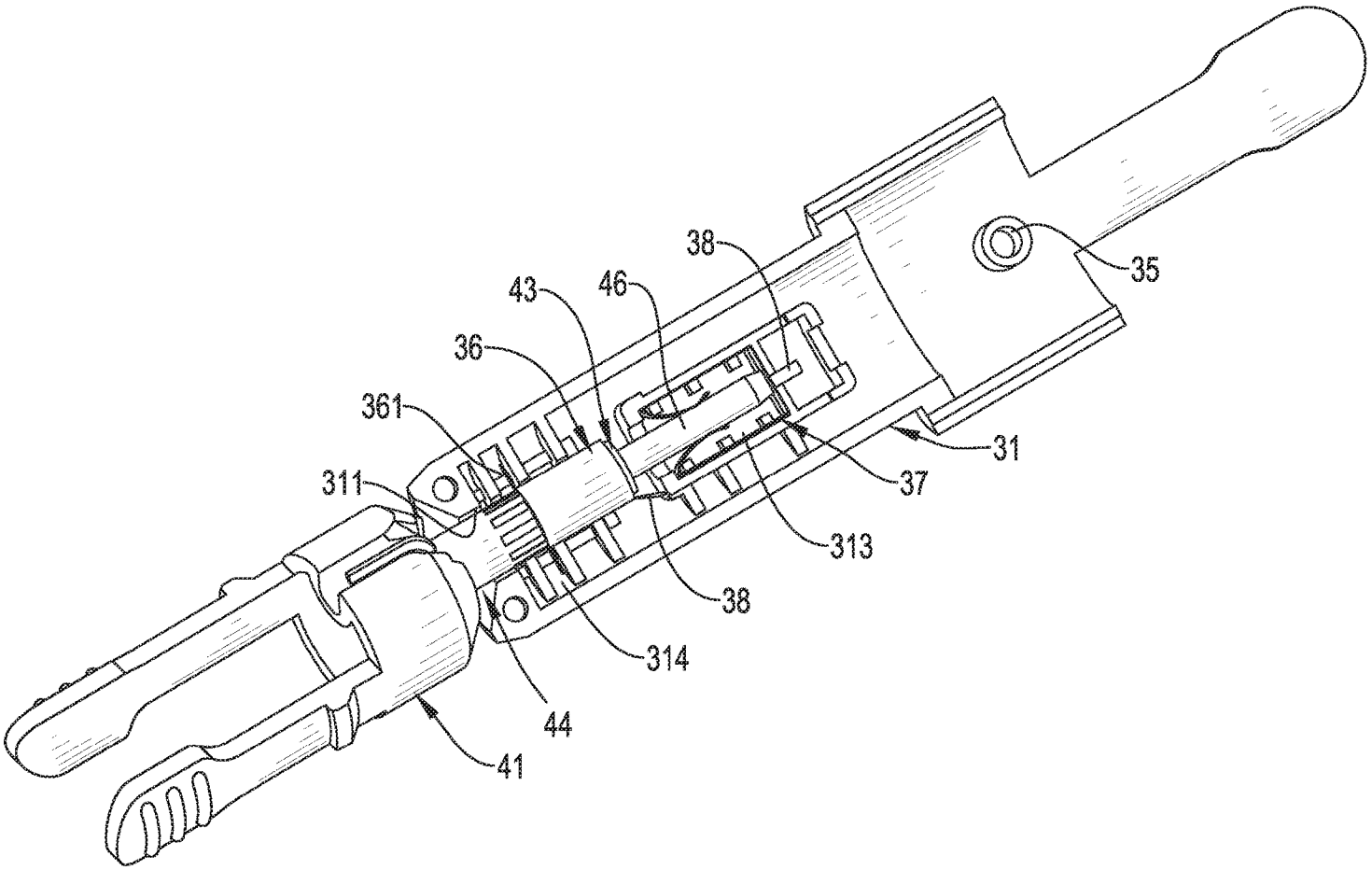
FIG. 4 is a perspective view of the electrical connector in FIG. 3, shown without a right insulating cover.
Figure 5:
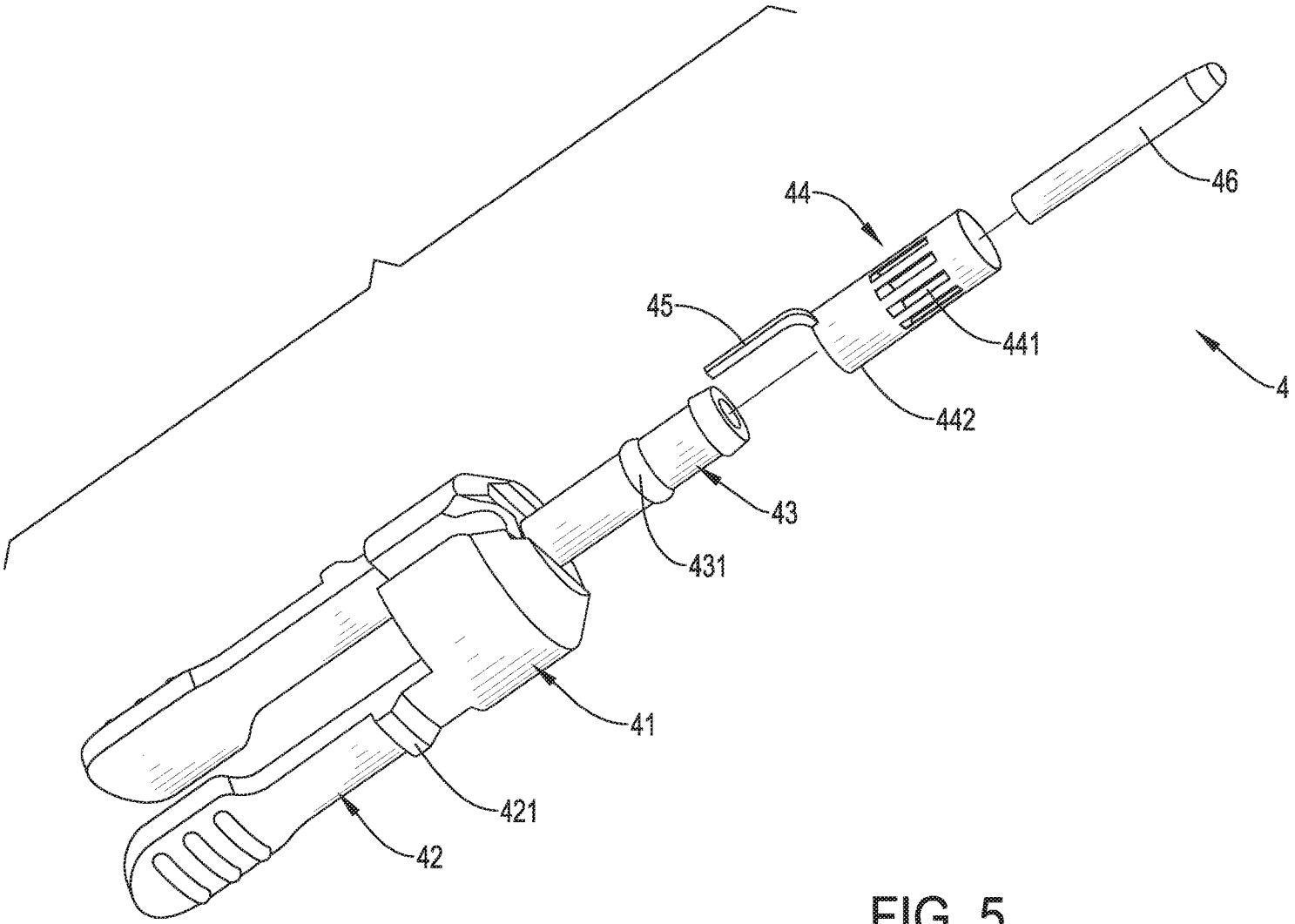
FIG. 5 is an exploded perspective view of a male insertion piece of the electrical connector in FIG. 1.
Figure 6:
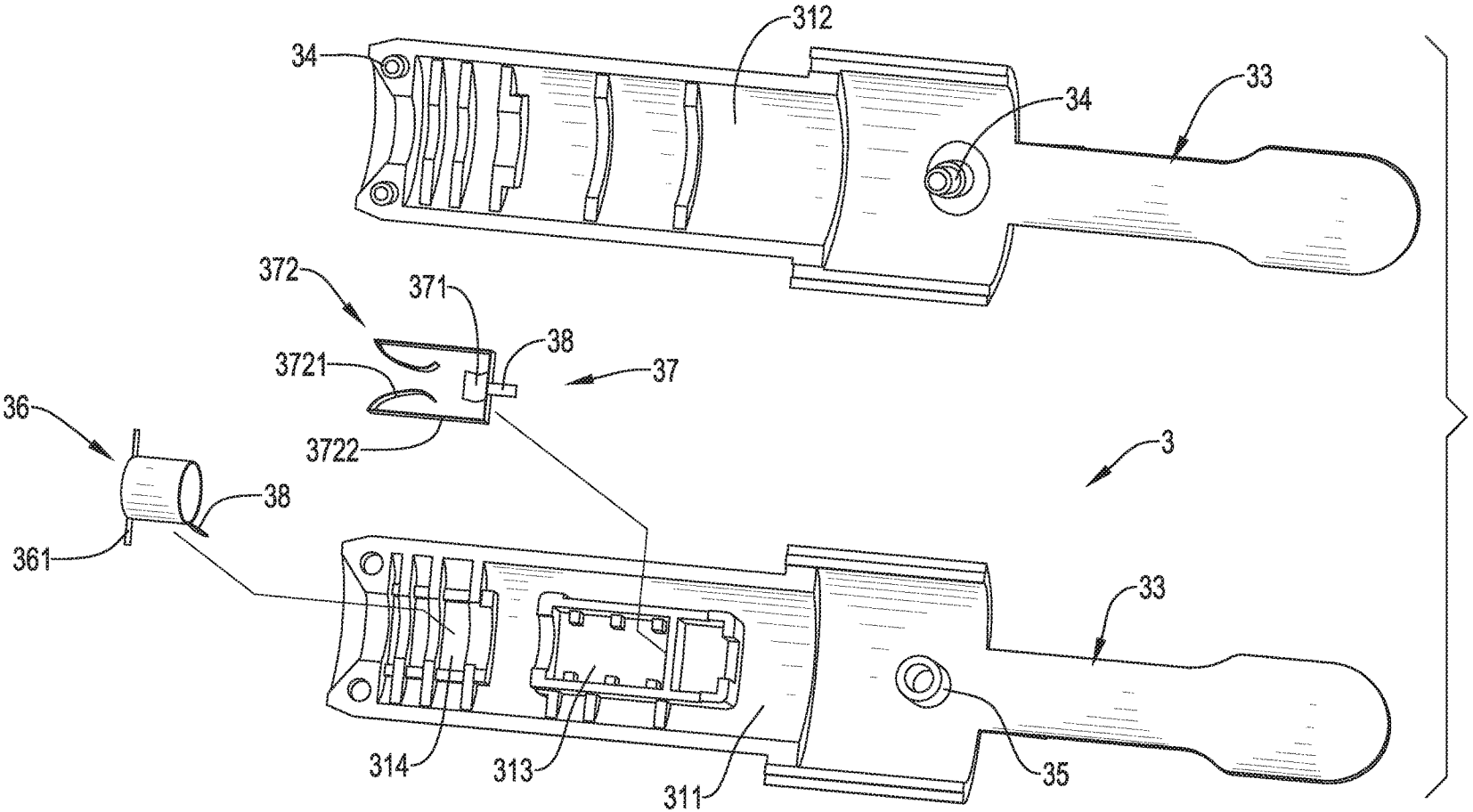
FIG. 6 is an exploded perspective view of a female insertion piece of the electrical connector in FIG. 1.
Figure 7:
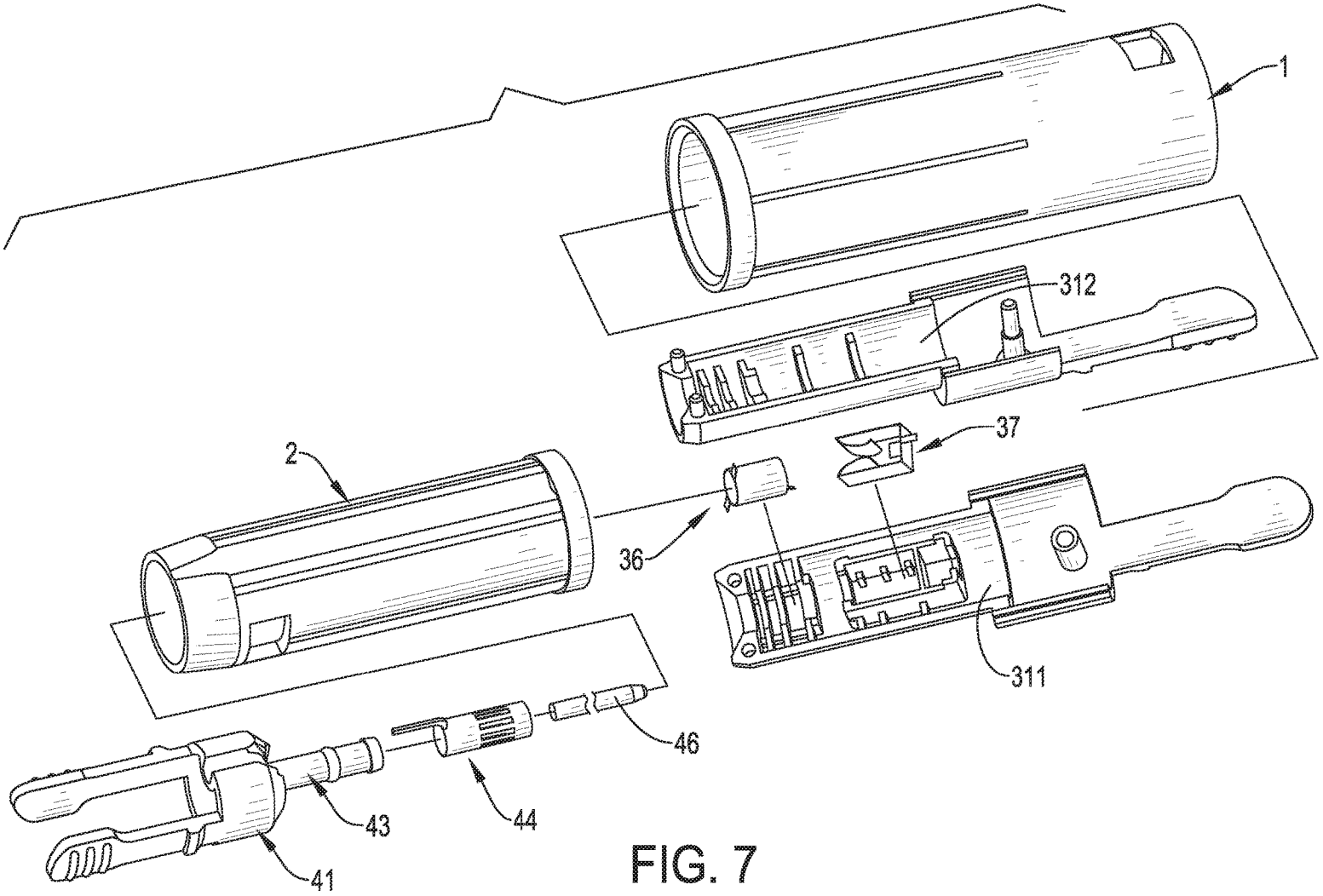
FIG. 7 is an exploded perspective view of the electrical connector in FIG. 1.

With reference to FIGS. 1 to 9, an electrical connector in accordance with the present invention includes a male insertion piece 4 and a female insertion piece 3. The male insertion piece 4 has an insulation base 41, an insulation tube 43, an outer electrode 44, and a conductive needle 46. The insulation tube 43 is hollow and is formed on one end of the insulation base 41. The outer electrode 44 is securely mounted around a periphery of the insulation tube 43. The conductive needle 46 is mounted in the insulation tube 43. The female insertion piece 3 has an insulation sleeve 31, an outer connection electrode 36, and an inner connection electrode 37. The insulation sleeve 31 has a guiding slot 311 formed inside the insulation sleeve 31 for the insulation tube 43 to be inserted into the guiding slot 311. The outer connection electrode 36 is mounted inside the insulation sleeve 31 and is mounted around and contacts a periphery of the outer electrode 44 of the male insertion piece 4. The inner connection electrode 37 is mounted inside the insulation sleeve 31, contacts the conductive needle 46 of the male insertion piece 4, and has a first conductive part 371 and two second conductive parts 372. The first conductive part 371 abuts against a top portion of the conductive needle 46. The two second conductive parts 372 hold two lateral portions of a periphery of the conductive needle 46. When the male insertion piece 4 engages the female insertion piece 3, the insulation tube 43 is inserted into the guiding slot 311, an inner surface of the outer connection electrode 36 abuts against an outer surface of the outer electrode 44, and the top portion and lateral portions of the periphery of the conductive needle 46 abut against the first conductive part 371 and the two conductive parts 372 of the inner connection electrode 37 respectively.

When the electrical connector is implemented, the outer electrode 44 and the conductive needle 46 of the male insertion piece 4 are connected to two wires respectively, and the outer connection electrode 36 and the inner connection electrode 37 of the female insertion piece 3 are connected to another two wires respectively, such that upon engagement of the male insertion piece 4 and the female insertion piece 3, subsequent wiring connection can thus be achieved. The outer electrode 44 and the outer connection electrode 36 are connected by way of surface contact to maintain good electrical conductivity. Conventionally, an element like the conductive needle 46 has two spring leaves mounted beside two lateral sides of the element to fulfill electrical connection between the element and the spring leaves. However, bad connection arises from such way of connection upon collision because point-to-point connection is involved and there are two contact points required. In the present embodiment, the first conductive part 371 and the two second conductive parts 372 abut against the conductive needle 46. In other words, there are three contact points between the conductive needle 46 and the inner connection electrode 37. Since the three contact points are located at different locations, a triangle can be formed by the three contact points, and what the triangle represents is a stable connection structure. When the electrical connector is subject to vibration, at least one of the contact points is still at a conducting state. In the present embodiment, the inner connection electrode 37 is U-shaped or takes the form of an inverted triangle.

Preferably, the two second conductive parts 372 of the inner connection electrode 37 are located on two lateral sides of the first conductive part 371, and each second conductive part 372 has a resilient section 3721 and a connection section 3722. The resilient section 3721 abuts against one of the lateral portions of the periphery of the conductive needle 46. The connection section 3722 is connected between the resilient section 3721 and the first conductive part 371.

Each second conductive part 372 may just include the resilient section 3721 that is obliquely connected with the first conductive part 371 or may include both the resilient section 3721 and the connection section 3722 with the resilient section 3721 connected with the first conductive part 371 through the connection section 3722, depending on actual wiring distribution.

Preferably, the two second conductive parts 372 are formed on a front side and/or a rear side of the first conductive part 371.

As the two second conductive parts 372 may be located at different positions with respect to the first conductive part 371, the contact points of the inner connection electrode 37 and the conductive needle 46 form a triangle for increasing the stability when the inner connection electrode 37 and the conductive needle 46 are in contact with each other. Preferably, each second conductive part 372 has an arced recess formed in a central portion thereof to match the periphery of the conductive needle 46. Thus, the second conductive part 372 can contact the conductive needle 46 by way of surface contact to enlarge the contact area.

Furthermore, the outer connection electrode 36 is tubular. Preferably, the outer connection electrode 36 has two positioning legs 361 formed on an edge of one of two openings of the outer connection electrode 36. The insulation sleeve 31 has two limiting grooves formed in an inner wall of the insulation sleeve 31 and engaging the respective positioning legs 361. The tubular shape of the outer connection electrode 36 allows the outer connection electrode 36 to be mounted around the outer electrode 44 and can be easily manufactured.

The outer electrode 44 has an arced slice 442 formed on the periphery of the insulation tube 43. Preferably, the insulation tube 43 has a bulged portion 431 formed around a central portion of the outer electrode 44. The arced slice 442 has multiple slits 441 centrally formed through the arced slice 442.

Upon mounting of the outer electrode 44, the arced slice 442 may be partially mounted around the insulation tube 43 or fully mounted around the insulation tube 43 as an annular slice, and the arced slice 442 is mounted around the periphery of the insulation tube 43. Because of the bulged portion 431 of the insulation tube 43, a central portion of the arced slice 442 is deformed and propped up to form the multiple slits 441. The thickness of the arced slice 442 is highest at a center portion thereof and is distributed in a way of progressively decreasing the thickness in a direction from the center portion to each of two edge portions of the arced slice 442. Such thickness distribution of the arced slice 442 allows the outer connection electrode 36 and the outer electrode 44 to be securely combined by tight fitting.

Preferably, the outer electrode 44 has a first wiring terminal 45 formed on one end thereof adjacent to the insulation base 41, and the insulation base 41 has an insertion slot 411 formed therein for the first wiring terminal 45 of the outer electrode 44 to be inserted therein.

The insulation sleeve 31 includes a left half sleeve 311 and a right half sleeve 312. The left half sleeve 311 has an inner holding recess 313 for the inner connection electrode 37 to be mounted therein and an outer holding recess 314 for the outer connection electrode 36 to be mounted therein. One of the left half sleeve 311 and the right half sleeve 312 has a positioning pin 34 and the other one of the left half sleeve 311 and the right half sleeve 312 has a positioning hole 35 to engage the positioning pin 34.

Dividing the insulation sleeve 31 into two parts facilitates the mounting and assembly of the inner connection electrode 37 and the outer connection electrode 36. Each of the inner connection electrode 37 and the outer connection electrode 36 has a second wiring terminal 38 for wiring connection.

The insulation base 41 has two first engagement legs 42 formed on and protruding outwardly from one end thereof distal to the insulation tube 43. Each first engagement leg 42 has a first protrusion 421 formed on an outer surface thereof. The electrical connector further includes an inner protection tube 2. One end of the inner protection tube 2 is mounted around a periphery of the insulation sleeve 31, and the other end of the inner protection tube 2 has two first engagement holes 21 respectively formed through two opposite locations of a peripheral wall of the inner protection tube 2 and respectively engaging the first protrusions 421 of the two first engagement legs 42 and is mounted around a periphery of the insulation base 41.

To protect the male insertion piece 4 and the female insertion piece 3 against external interference, the inner protection tube 2 is brought into play. When used, the inner protection tube 2 can be mounted around the female insertion piece 3. When the male insertion piece 4 is inserted into the female insertion piece 3, the insulation base 41 is inserted into the inner protection tube 2, and the first protrusions 421 of the first engagement legs 42 are inserted into the respective first engagement holes 21. Preferably, the inner protection tube 2 has a limiting ring formed on an inner wall of the inner protection tube 2 to limit a length of the female insertion piece 3 into the inner protection tube 2. As the first engagement legs 42 are extended into the air and engage the inner protection tube 2, the first engagement legs 42 require a certain degree of flexibility for them to be pressed to disengage from the inner protection tube 2 or to be released to engage the inner protection tube 2.

The female insertion piece 3 has an outer connection tube 32 formed on one end of the insulation sleeve 31 distal to the outer holding recess 314. An outer diameter of the outer connection tube 32 is greater than an inner diameter of the inner protection tube 2. The outer connection tube 32 has two second engagement legs 33 formed on and protruding outwardly from the outer connection tube 32. Each second engagement leg 33 has a second protrusion 331 formed on an outer surface of the second engagement leg 33. The electrical connector further includes an outer protection tube 1. The outer protection tube 1 has two second engagement holes 11 engaging the respective second protrusions 331. One end of the outer protection tube 1 is mounted around a periphery of the inner protection tube 2, and the other end of the outer protection tube 1 is mounted around the outer connection tube 32 with the second engagement holes 11 engaging the respective second protrusions 331. The outer connection tube 32 serves to provide more protection and prevent the female insertion piece 3 from disengaging from the male insertion piece 4.

Preferably, the insulation base 41 has at least two first engagement legs 42 parallelly formed thereon and protruding outwardly, and the outer connection tube 32 has at least two second engagement legs 33 parallelly formed thereon and protruding outwardly. Moreover, a line perpendicularly connected between the two first engagement legs 42 is perpendicular to a line perpendicularly connected between the two second engagement legs 33.

The number of the first engagement legs 42 and the second engagement legs 33 can be configured according to demands. Upon assembly of the first engagement legs 42 and the second engagement legs 33, the line perpendicularly connected between the two first engagement legs 42 is different from the line perpendicularly connected between the two second engagement legs 33 to ensure differentiation and fool proof in assembly.

To facilitate engagement and disengagement with the first engagement holes 21 and the second engagement holes 11, each of the first protrusion 421 and the second protrusion 331 has an inclined lateral side.

Figure 8:
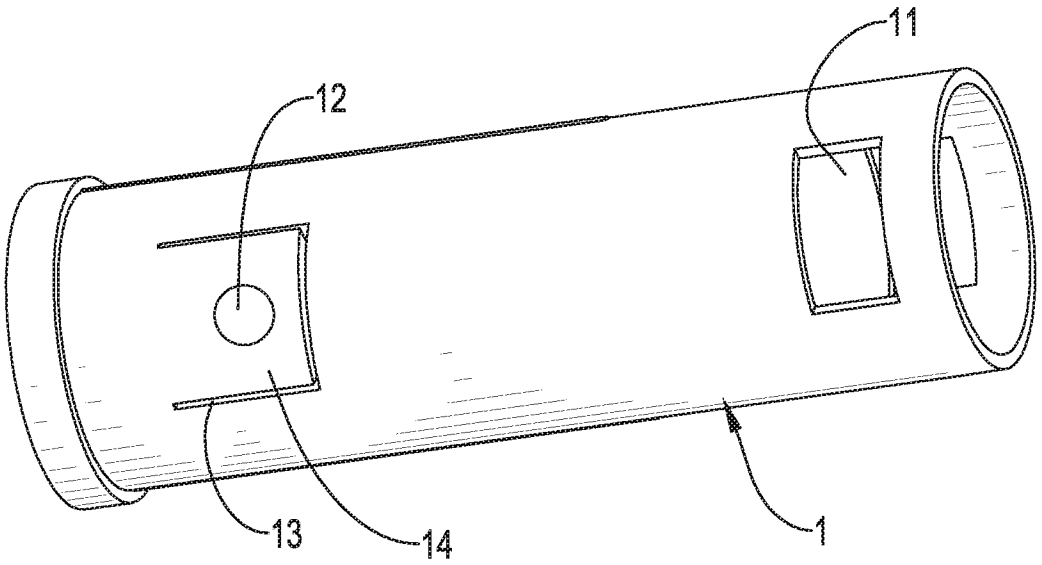
FIG. 8 is a perspective view of the outer protective sleeve of the electrical connector in FIG. 1.

With reference to FIG. 8, to facilitate connection with a support object, such as a branch of a Christmas tree, the outer protection tube 1 has a bump 12 formed thereon. Preferably, the outer protection tube 1 has three cuts cutting through a peripheral wall of the outer protection tube 1 and sequentially connected, and a portion of the peripheral wall of the outer connection tube 1 formed within the three cuts 13 is an elastic piece 14 that can be elastically bent up and down. The bump 12 is formed on the elastic piece 14. Upon actual assembly process, a Christmas tree can be formed by iron tubes and the iron tubes have engagement holes formed in peripheral walls thereof, such that the bump 12 on the outer protection tube 1 can engage a corresponding engagement hole on the iron tube to fix the electrical connector on the Christmas tree. The cuts 13 may be arc-shaped or U-shaped. The bump 12 may take the form of a spherical cap or a cuboid.

Figure 9:
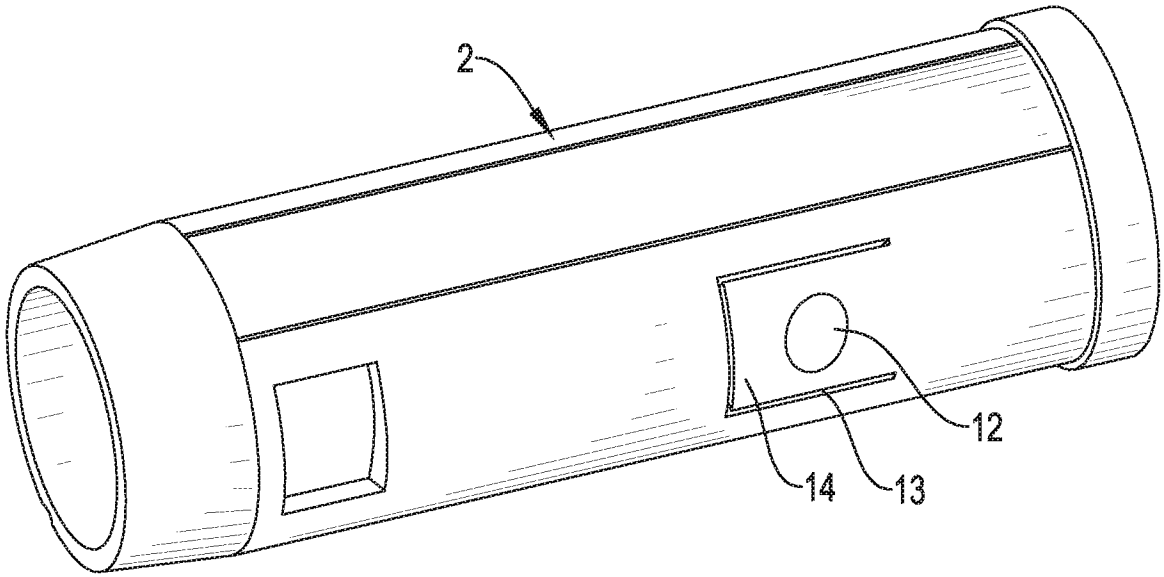
FIG. 9 is a perspective view of the inner protective sleeve of the electrical connector in FIG. 1.

With reference to FIG. 9, the inner protection tube 2 can also have the similar bump 12, the cuts 13 and the elastic piece 14. Upon an actual assembly process, a Christmas tree can be formed by iron tubes and the iron tubes have engagement holes formed in peripheral walls thereof, such that the bump 12 on the inner protection tube 2 can engage a corresponding engagement hole on the iron tube to fix the electrical connector on the Christmas tree. The cuts 13 may be arc-shaped or U-shaped. The bump 12 may take the form of a spherical cap or a cuboid.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a male insertion piece having:

an insulation base;

an insulation tube being hollow and formed on one end of the insulation base;

an outer electrode securely mounted around a periphery of the insulation tube; and a conductive needle mounted in the insulation tube;

a female insertion piece having:

an insulation sleeve having a guiding slot formed inside the insulation sleeve for the insulation tube to be inserted into the guiding slot;

an outer connection electrode mounted inside the insulation sleeve, the outer connection electrode mounted around and contacting a periphery of the outer electrode of the male insertion piece; and an inner connection electrode mounted inside the insulation sleeve, contacting the conductive needle of the male insertion piece, and having:

a first conductive part abutting against a top portion of the conductive needle; and at least two second conductive parts holding two lateral portions of a periphery of the conductive needle;

wherein when the male insertion piece engages the female insertion piece, the insulation tube is inserted into the guiding slot, an inner surface of the outer connection electrode abuts against an outer surface of the outer electrode, and the top portion and the lateral portions of the periphery of the conductive needle abut against the first conductive part and the at least two conductive parts of the inner connection electrode respectively.

2. The electrical connector as claimed in claim 1, wherein the at least two second conductive parts of the inner connection electrode include two second conductive parts located on two lateral sides of the first conductive part.

3. The electrical connector as claimed in claim 1, wherein the at least two second conductive parts of the inner connection electrode include two second conductive parts formed on a front side and/or a rear side of the first conductive part.

4. The electrical connector as claimed in claim 1, wherein the outer connection electrode is tubular and has two positioning legs formed on an edge of one of two openings of the outer connection electrode, and the insulation sleeve has two limiting grooves formed in an inner wall of the insulation sleeve and engaging the respective positioning legs.

5. The electrical connector as claimed in claim 1, wherein the outer electrode has an arced slice formed on the periphery of the insulation tube, the insulation tube has a bulged portion formed around a central portion of the outer electrode, and the arced slice has multiple slits centrally formed through the arced slice.

6. The electrical connector as claimed in claim 1, wherein the outer electrode has a first wiring terminal formed on one end of the outer electrode adjacent to the insulation base, and the insulation base has an insertion slot formed therein for the first wiring terminal of the outer electrode to be inserted in the insertion slot.

7. The electrical connector as claimed in claim 5, wherein the outer electrode has a first wiring terminal formed on one end of the outer electrode adjacent to the insulation base, and the insulation base has an insertion slot formed therein for the first wiring terminal of the outer electrode to be inserted in the insertion slot.

8. The electrical connector as claimed in claim 1, wherein the insulation sleeve includes:

a left half sleeve having:

an inner holding recess for the inner connection electrode to be mounted therein; and an outer holding recess for the outer connection electrode to be mounted therein; and a right half sleeve.

9. The electrical connector as claimed in claim 8, further comprising an inner protection tube, wherein the insulation base has two first engagement legs formed on and protruding outwardly from one end thereof distal to the insulation tube, each first engagement leg has a first protrusion formed on an outer surface thereof, one end of the inner protection tube is mounted around a periphery of the insulation sleeve, and the other end of the inner protection tube has two first engagement holes respectively formed through two opposite locations of a peripheral wall of the inner protection tube and respectively engaging the first protrusions of the two first engagement legs and is mounted around a periphery of the insulation base.

10. The electrical connector as claimed in claim 9, further comprising an outer protection tube, wherein the female insertion piece has an outer connection tube formed on one end of the insulation sleeve distal to the outer holding recess, an outer diameter of the outer connection tube is greater than an inner diameter of the inner protection tube, the outer connection tube has two second engagement legs formed on and protruding outwardly from the outer connection tube, each second engagement leg has a second protrusion formed on an outer surface of the second engagement leg, the outer protection tube has two second engagement holes engaging the respective second protrusions, one end of the outer protection tube is mounted around a periphery of the inner protection tube, and the other end of the outer protection tube is mounted around the outer connection tube with the second engagement holes engaging the respective second protrusions.

11. The electrical connector as claimed in claim 10, wherein the insulation base has at least two first engagement legs formed thereon and protruding outwardly, and the outer connection tube has at least two second engagement legs formed thereon and protruding outwardly.

* * * * *